US005539499A

United States Patent [19]

Fujisawa

[11] Patent Number: 5,539,499

[45] Date of Patent: Jul. 23, 1996

[54] IMAGE FORMING APPARATUS WITH IMPROVED WARNING INDICATION FOR PLURALITY OF TROUBLES

[75] Inventor: Kazuhiro Fujisawa, Nara, Japan

[73] Assignee: Minolta Camera Kabushiki Kaisha, Osaka, Japan

[21] Appl. No.: 103,890

[22] Filed: Aug. 6, 1993

[30] Foreign Application Priority Data

Aug. 7, 1992 [JP] Japan ..... 4-211369

[51] Int. Cl.[6] ..... G03G 21/00

[52] U.S. Cl. ..... 355/206; 355/203; 355/208

[58] Field of Search ..... 355/203, 204, 355/205, 206, 208, 209; 371/15.1, 16.1, 16.4, 16.5, 29.1; 395/183.01, 183.22, 185.01, 185.1

[56] References Cited

U.S. PATENT DOCUMENTS 4,398,819 8/1983 Schron .
4,475,806 10/1984 Daughton et al. ..... 355/209
4,572,652 2/1986 Tada et al. ..... 355/206
4,609,919 9/1986 Miyazaki et al. ..... 355/206 X
5,010,551 4/1991 Goldsmith et al. ..... 371/16.4
5,243,382 9/1993 Takano et al. ..... 355/207

FOREIGN PATENT DOCUMENTS 0287178 12/1991 Japan ..... 355/206

*Primary Examiner*—Sandra L. Brase
*Attorney, Agent, or Firm*—Price, Gess & Ubell

[57] ABSTRACT

Upon detecting a plurality of troubles based on input numerals by various sensors and the like, warnings corresponding to respective troubles simultaneously appear on a part of a liquid crystal display as pictorial characters, and a help key blinks. Processing contents for the warning of the highest priority appears on the liquid crystal display, as well. Each time the help key is turned on, processing contents for a warning on display changes into that for another warning corresponding to each pictorial character according to the order of priority.

24 Claims, 12 Drawing Sheets

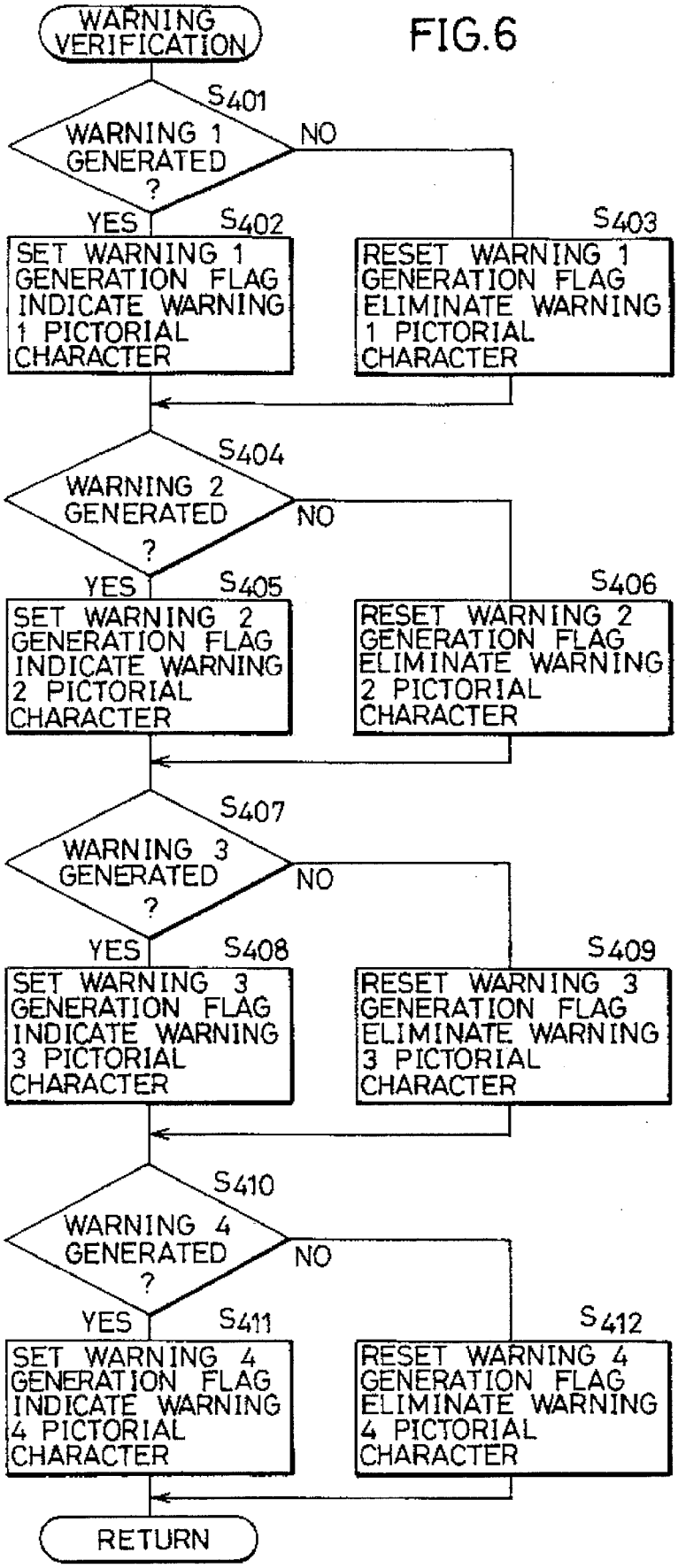
FIG.6
WARNING VERIFICATION
S401
WARNING 1 GENERATED ?
NO
YES
S402
SET WARNING 1 GENERATION FLAG INDICATE WARNING 1 PICTORIAL CHARACTER
S403
RESET WARNING 1 GENERATION FLAG ELIMINATE WARNING 1 PICTORIAL CHARACTER
S404
WARNING 2 GENERATED ?
NO
YES
S405
SET WARNING 2 GENERATION FLAG INDICATE WARNING 2 PICTORIAL CHARACTER
S406
RESET WARNING 2 GENERATION FLAG ELIMINATE WARNING 2 PICTORIAL CHARACTER
S407
WARNING 3 GENERATED ?
NO
YES
S408
SET WARNING 3 GENERATION FLAG INDICATE WARNING 3 PICTORIAL CHARACTER
S409
RESET WARNING 3 GENERATION FLAG ELIMINATE WARNING 3 PICTORIAL CHARACTER
S410
WARNING 4 GENERATED ?
NO
YES
S411
SET WARNING 4 GENERATION FLAG INDICATE WARNING 4 PICTORIAL CHARACTER
S412
RESET WARNING 4 GENERATION FLAG ELIMINATE WARNING 4 PICTORIAL CHARACTER
RETURN

| WARNING No | WARNING CONTENTS | PICTORIAL CHARACTER |
|---|---|---|
| 1 | PAPER JAM INDICATION | |
| 2 | TONER SUPPLY INDICATION | |
| 3 | COPY REMOVE INDICATION | |
| 4 | MAINTENANCE CALL INDICATION | |

IMAGE FORMING APPARATUS WITH IMPROVED WARNING INDICATION FOR PLURALITY OF TROUBLES

BACKGROUND OF THE INVENTION

1. Field of the Invention

The present invention relates to image forming apparatus, and particularly to an image forming apparatus having an operation panel indicating warnings for various troubles.

2. Description of the Related Art

In the case of a plurality of troubles, a conventional image forming apparatus, such as a copying machine, indicates warnings for the troubles only by means of pictorial characters, or indicates only a warning message of higher priority.

In the method of indicating a warning in the conventional image forming apparatus mentioned above, when a plurality of troubles occur, all the warnings for the troubles are indicated simply by pictorial characters, or only a warning of higher priority is specifically indicated. Indication by a pictorial character alone may not be enough for an unexperienced user to understand what is being informed of in the former method, while occurrence of other warnings might not be noticed in the latter method.

SUMMARY OF THE INVENTION

One object of the present invention is to indicate accurately a warning for a trouble in an image forming apparatus.

Another object of the present invention is to indicate all warnings for troubles without omission in an image forming apparatus.

Still another object of the present invention is to indicate clearly the contents of treatment for all warnings for troubles in a image forming apparatus.

In order to accomplish these objects, the image forming apparatus in accordance with the present invention includes detection means capable of detecting a plurality of troubles, information means for informing of occurrence of the plurality of troubles based on the detected result of the detection means, indication means for indicating a prescribed trouble among the detected plurality of troubles, and switch means for switching the indication of the trouble by the indication means to that of another trouble which is not being on display.

In the image forming apparatus thus structured, the occurrence of a plurality of troubles can be informed of, and a trouble indication can be switched to another one that is not being on display, whereby the contents of all the troubles can be accurately grasped.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 is a flow chart specifically showing the warning verification routine of FIG. 5.

DESCRIPTION OF THE PREFERRED EMBODIMENTS

Figure 1:
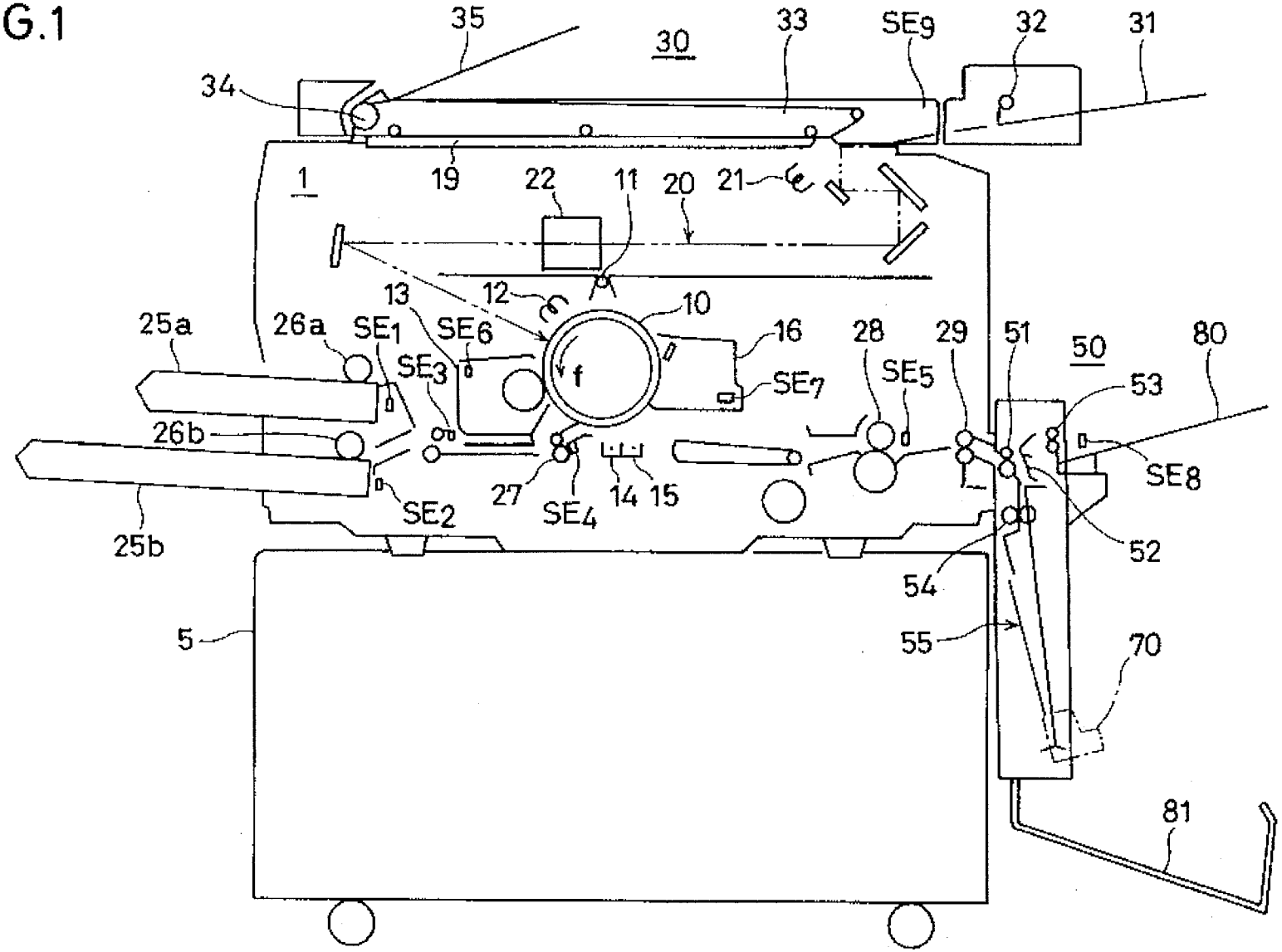
FIG. 1 is a cross sectional view showing the structure of a copying machine in accordance with a first embodiment of the present invention.

FIG. 1 is a cross sectional view showing the structure of a copying machine as an image forming apparatus in accordance with one embodiment of the present invention.

Referring to the figure, a body 1 is mounted on a desk 5. On the upper side of body 1 is attached an automatic document feeder (hereinafter referred to as "ADF") 30 of a circulation type, and on the right side of body 1 is attached a sheet processing unit 50 having a function of stapling copied sheets.

(Body)

Inside body 1, a photoreceptor drum 10 which is rotatively drivable in the direction of the arrow f is provided, around which an eraser lamp 11, a rotation charger 12, a developing unit 13 of a magnetic blush type, a transfer charger 14, a sheet separation charger 15, a remaining toner cleaning unit 16 of a blade type and the like are provided along the direction of rotation. Since the structure and operation of these image forming elements are well known, they are not described in detail here.

An optical system 20 includes an exposure lamp 21, an image forming lens 22, and a driving device moving various mirrors, lamp 21 and a mirror depending on copying magnification.

Copy sheets, which are contained in automatic paper feed cassettes **25*a* and 25*b*, are fed by a sheet from either of the cassettes based on rotation of either of paper feed rollers 26*a* and 26*b*, and further fed to a transfer portion by a timing roller 27 in synchronization with an image formed on photoreceptor drum 10. After the transfer, each of the sheets is fed to a fixing unit 28 to be subjected to fixing process of toner, and subsequently discharged through a discharge roller 29 outside the body 1. Sheet size detecting sensors SE1 and SE2 are provided for a cassette which is installed in a portion of body 1. The operational state of each of sensors SE1 and SE2 is changed depending on the arrangement or position of protrusions, magnets, or the like formed on or attached to cassettes 25***a* and 25*b*, whereby respective sheet sizes, including the setting direction, of cassettes 25*a* and 25*b* are determined by specific codes. Jam detecting sensors SE3–SE5 are provided in a transport path of sheets the for detecting the jamming of paper and the like. A toner empty detecting sensor SE6 provided inside developing unit 13 detects a consumption state of toner. A detecting sensor for recovered toner SE7 provided inside cleaning unit 16 detects the amount of recovered toner.

(Automatic Document Feeder)

ADF30 includes an original tray 31, a paper feed roller 32, a transport belt 33, a discharge tray 35 and an original size detecting sensor SE9. ADF30 can sequentially transport originals set on tray 31 from the uppermost layer. Originals are set on tray 31 with the front surface of the first page facing down, drawn from the last page by rotation of paper feed roller 32, and fed between transport belt 33 rotating clockwise in the drawing and a platen glass 19. Each of the originals is set on a predetermined position of platen glass 19 by rotation of transport belt 33 to be irradiated with light by optical system 20. After exposure of the image, the original is transported to the left in the drawing on platen glass 19 by transport belt 33 to be discharged from a discharge guard roller 34 onto tray 35 with an image plane facing up.

The size of the original fed from tray 31 is detected by sensor SE9, including detection as to whether its transported manner is a longitudinal feed (which means that the longitudinal direction of the original is parallel to the feed direction of the original), or a lateral feed (which means that the longitudinal direction is perpendicular to the feed direction).

ADF30 can turn upward with the inmost of body 1 as a fulcrum, so that it functions similarly to an original cover when an operator sets an original on platen glass 19.

(Sheet Processing Unit)

Sheet Processing Unit 50 has a function of storing copied sheets on a tray 80 in a stack, and a function of stapling the copied sheets by an electric stapler 70 after storing and arranging them in a staple tray 55. Change of paper feeding direction is carried out by a change claw 52 driven by a solenoid not shown. In a discharge mode, a sheet is guided from an accept roller 51 by the upper face of change claw 52 set on a predetermined position to be discharged through discharge roller 53 onto tray 80. In a staple mode, a sheet is guided downward from accept roller 51 by the side surface of change claw 52 set on another predetermined position to be stored through an accommodate roller 54 in staple tray 55.

Figure 2:
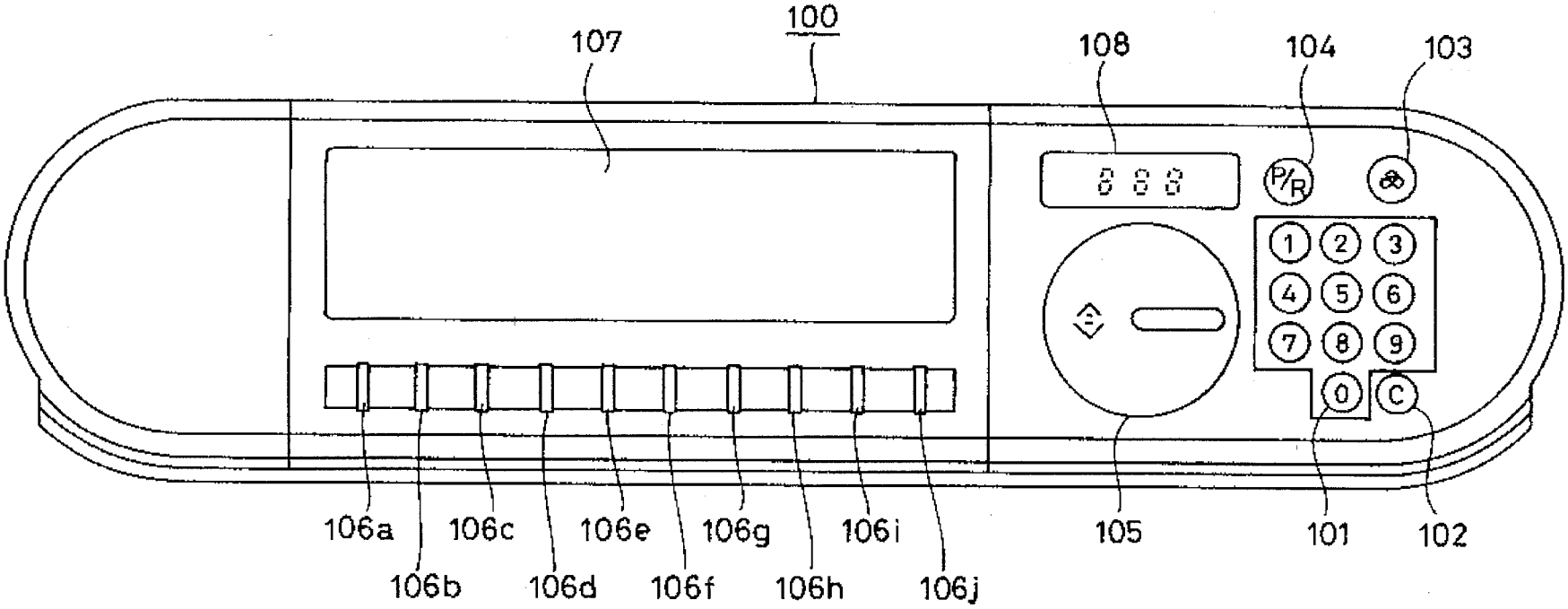
FIG. 2 is a top plan view showing the structure of an operation panel provided at the upper portion of the copying machine of FIG. 1.

FIG. 2 is a top plan view showing the structure of the operation panel provided on the upper surface of the copying machine of FIG. 1.

Referring to the figure, operation panel 100 includes a ten-key 101 for inputting a variety of numerals, a clear key 102 for clearing an input value, a stop key 103 for stopping a copying operation, a panel reset key 104 for resetting contents set on the operation panel, a print key 105 for instructing a printing operation (which is green when the copying machine is ready to print, and otherwise orange), set keys 106*a*–106*j*, each having an LED built in, for setting various states, a liquid crystal display (LCD) 107 for showing various set states or information of the copying machine, and a seven-segment LED 108 for indicating input numerals by ten-key 101.

Figure 3:
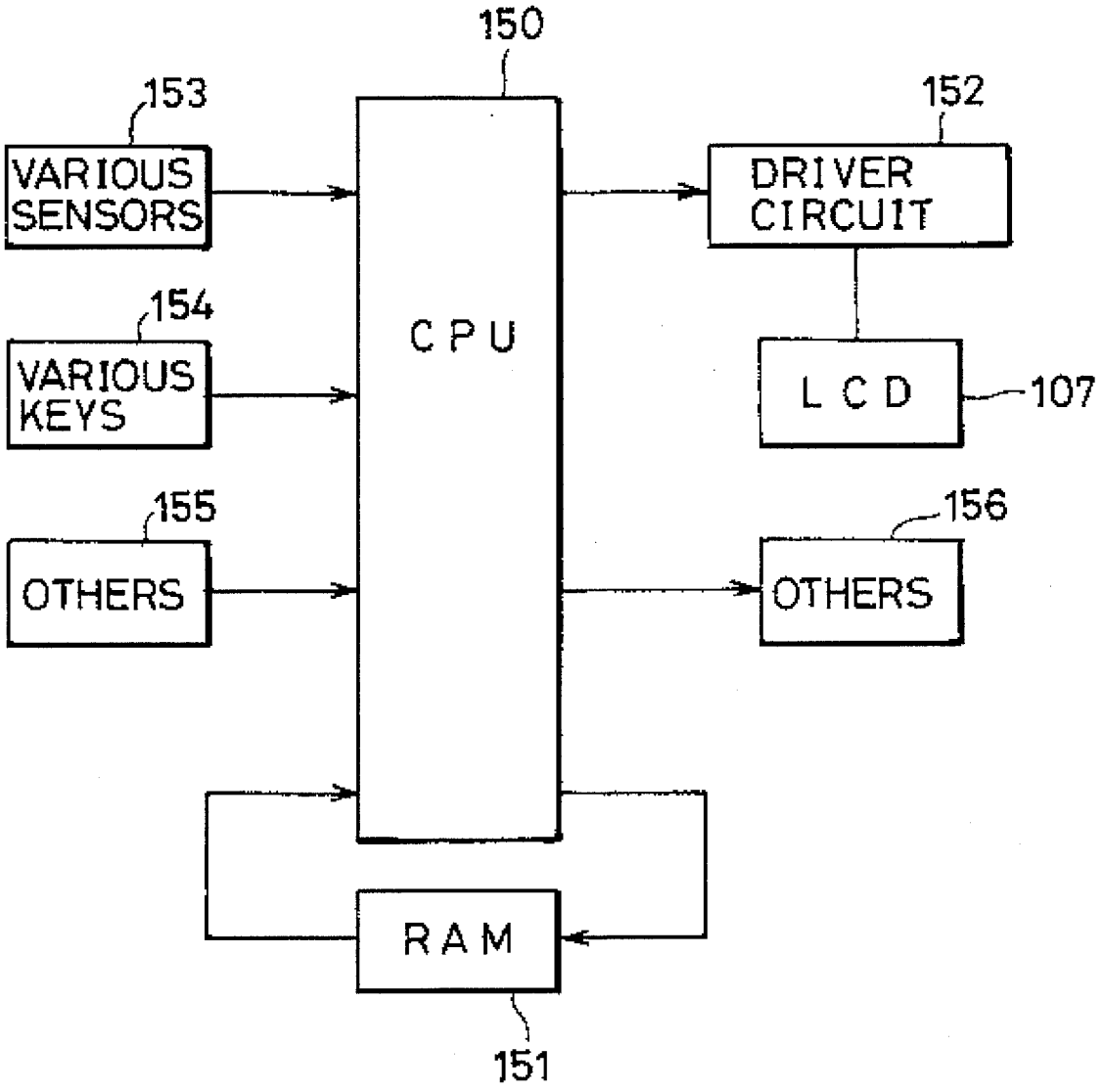
FIG. 3 is a block diagram showing the internal structure of the copying machine of FIG. 1.

FIG. 3 is a block diagram showing the internal structure of the copying machine of FIG. 1.

Referring to the figure, centering a CPU 150 constituted of a microcomputer, for example, the copying machine includes various sensors 153 providing a detected result to CPU 150, various keys 154 having set information input thereto, and the other parts 155. CPU 150 applies a control signal to a driver circuit 152 for driving LCD 107 on the operation panel, and also applies various control signals to the other parts 156. An RAM 151 used for storage of various information and the like is connected to CPU 150.

Figure 4:
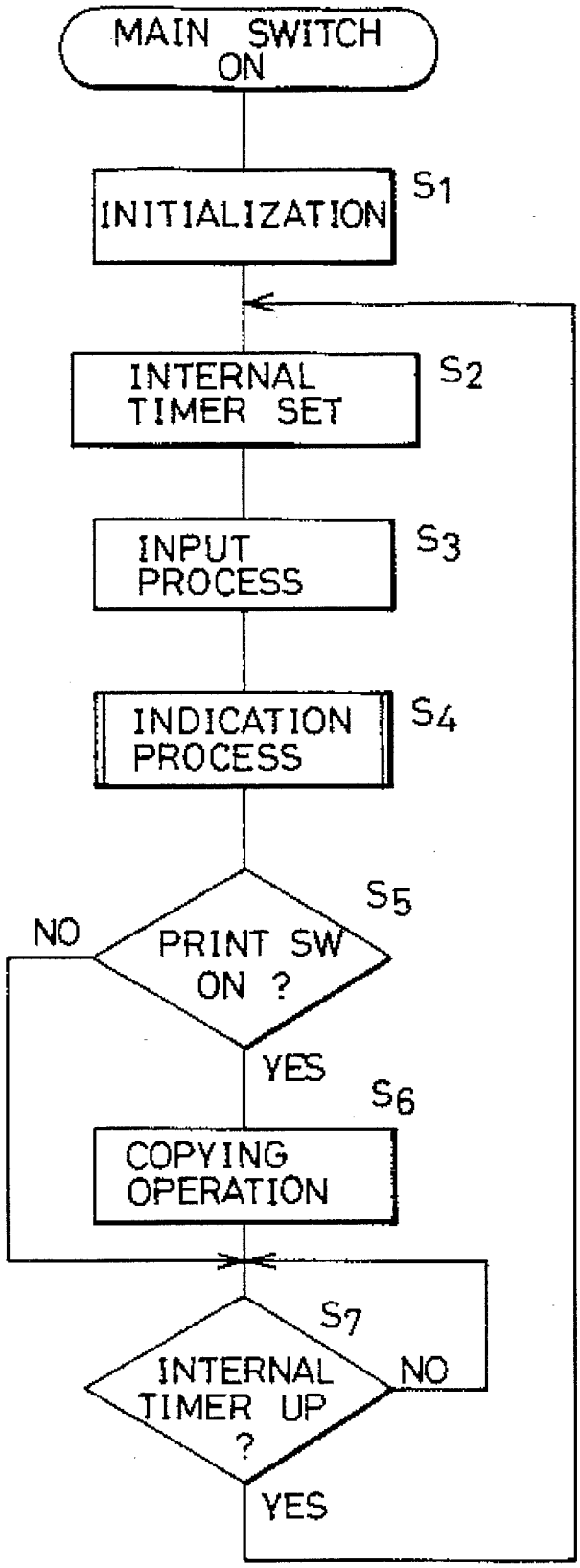
FIG. 4 is a main flow chart showing the copying operation of the copying machine of FIG. 1.

FIG. 4 is a flow chart showing a main routine of the copying operation of the copying machine of FIG. 1.

On turning on a main switch, initialization is performed at step S1, and time determining a length of one routine is set by an internal timer at step S2. At step S3, receipt process of a signal input from various sensors and keys is performed, and if the input signal is abnormal, a warning code is produced according to the abnormality. Subsequently, indication process with regard to the warning is performed at step S4. This indication process will be described in detail later.

At step S5, whether a print switch is turned on or not is determined, and if the print switch is turned on, a copying operation is performed at step S6. After waiting for termination of the internal timer at step S7, the flow returns back to step S2, and the same copying operation is repeated.

Figure 5:
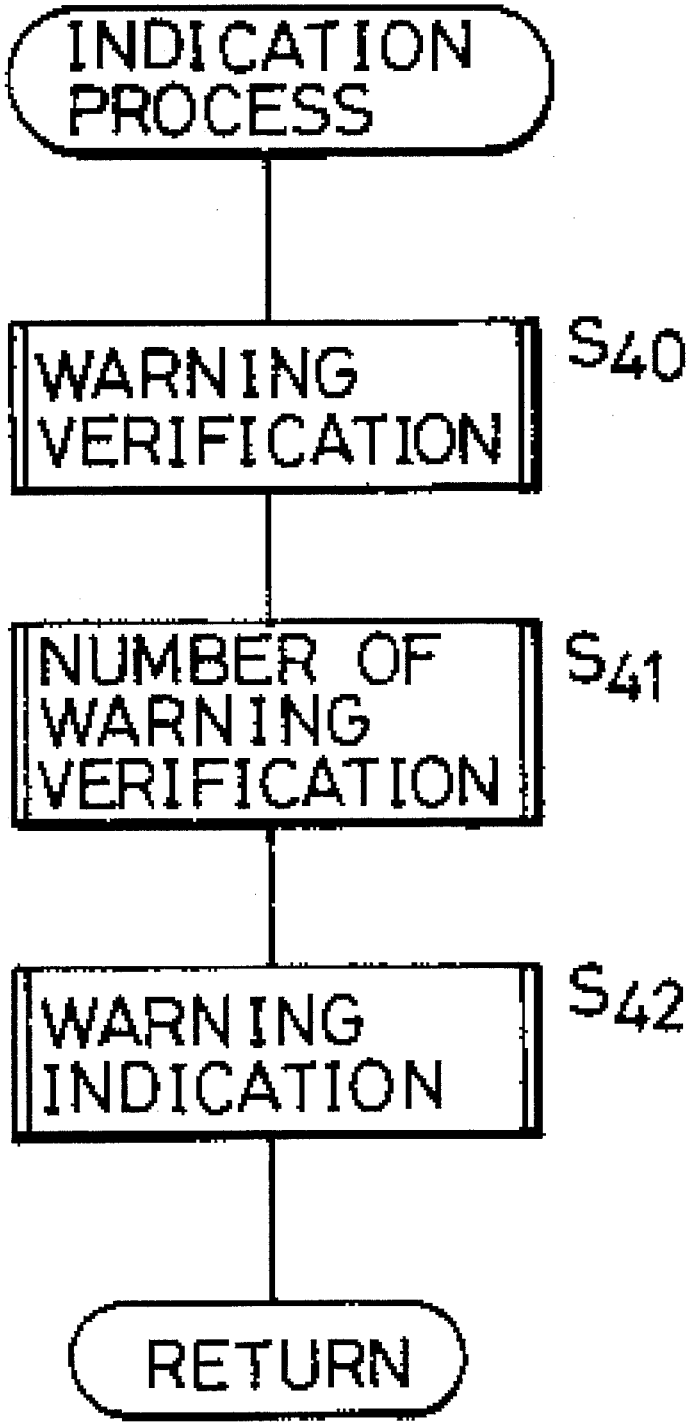
FIG. 5 is a flow chart specifically showing the indication process routine of FIG. 4.

FIG. 5 is a flow chart specifically showing the structure of the contents of the indication process in FIG. 4.

Entering the indication process routine, whether warnings based on troubles are generated or not is verified at step S40. If warnings are generated, the number of the warnings is verified at step S41, and after indication of the generated warnings at step S42, the flow returns to the main routine of FIG. 4. The contents of each process in steps S40 to S42 will hereinafter be described in detail.

FIG. 6 is a flow chart specifically showing the warning verification routine of FIG. 5.

Figures 7, 8:
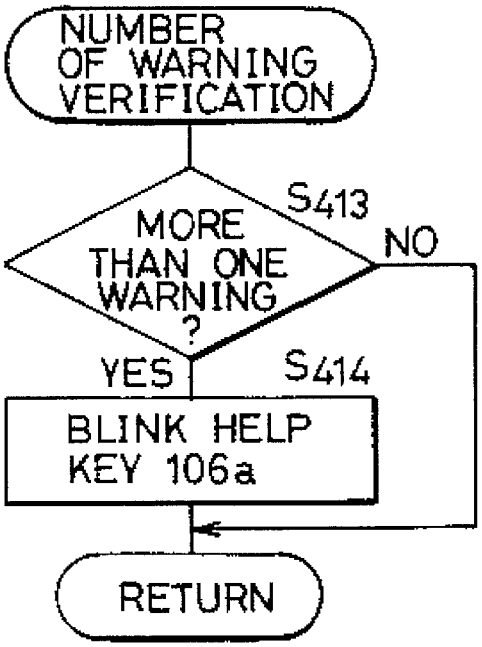
FIG. 7 is a flow chart specifically showing the number-of-warning verification routine.
FIG. 8 is a table showing the specific contents of the warnings used in the first embodiment of the present invention.

In this embodiment, four warnings are handled as shown in FIG. 8, the order of priority of which is as follows. That is, a warning of the first priority is a paper jam indication (hereinafter referred to as "warning 1"), a warning of the second priority is a toner supply indication (hereinafter referred to as "warning 2"), a warning of the third priority is a copy remove indication (hereinafter referred to as "warning 3"), and a warning of the fourth priority is a maintenance call indication (hereinafter referred to as "warning 4"). The contents of pictorial characters for respective warnings are shown in FIG. 8.

Referring to the flow chart of FIG. 6, entering the warning verification routine, whether the warning 1 is generated or not is determined at step S401. The warning 1 indicates the case where jamming of paper is detected by one of jam detecting sensors SE3 to SE5, and then the indication therefor is required. When the warning 1 is generated, a generation flag of the warning 1 is set, and the pictorial character of the warning 1 is displayed on LCD 107 of the operation panel at step S402.

When the warning 1 is not generated, the generation flag of the warning 1 is reset, and the pictorial character indicating the contents of the warning 1 is eliminated from LCD 107 of the operation panel.

Subsequently, in the same manner as described above, the presence or absence of generation of respective warnings 2 to 4 is determined, and according to the result, set or reset of various generation flags and indication or elimination of pictorial characters corresponding to respective warnings are performed. Thereafter, the flow returns to the main routine. As described above, the presence or absence of generation of warnings are determined in the order of priority of the warnings, whereby the warnings are displayed on LCD 107 from the one having a higher priority.

FIG. 7 is a flow chart specifically showing the number-of-warning verification routine of FIG. 5.

Entering the number-of-warning verification routine, whether the number of the warnings is more than one or not is determined. If the number of the warnings is more than one, after blinking of help key 106*a* on operation panel 100 at step S414, the flow returns to the main routine. If the number of the warnings is not more than one, the flow returns to the main routine without any process.

Figure 9:
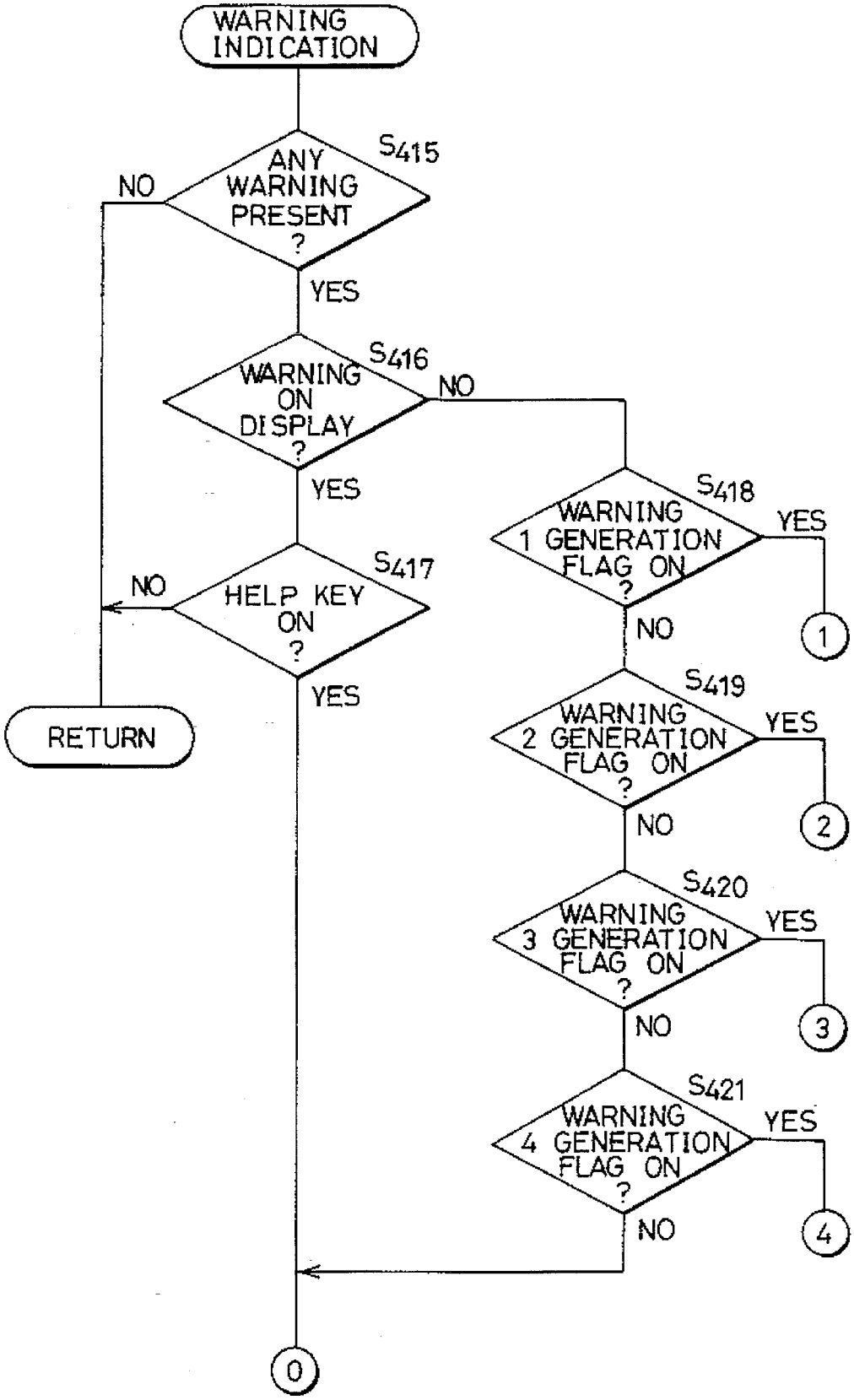
FIG. 9 is a part of a flow chart specifically showing the warning indication routine of FIG. 5.
Figure 10:
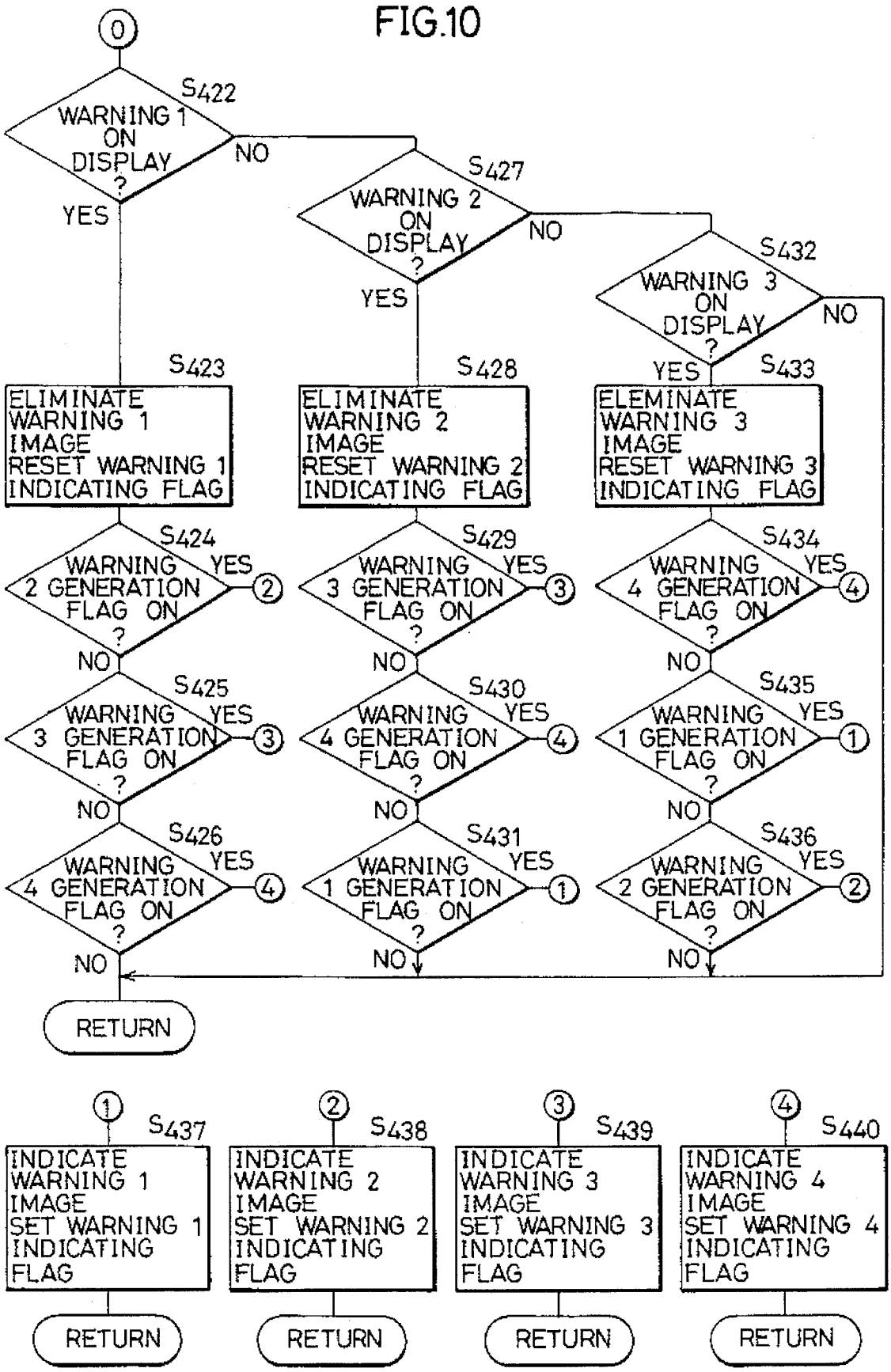
FIG. 10 is another part of the flow chart specifically showing the warning indication routine of FIG. 5.

FIGS. 9 and 10 are flow charts specifically showing the warning indication routine of FIG. 5.

Entering the warning indication routine, whether any warning is present or not is determined at step S415, and if no warning is present, warning indication is not required, and thus the flow returns to the main routine without any process.

If a warning is present, then, a determination is made at step S416, as to whether the warning is on display or not, specifically, whether any of indication flags of the warnings 1 to 4 is set or not, in other words, whether the specific contents of the warning is displayed on LCD 107 or not. If the warning is on display, whether the help key is turned on or not is determined at step S417. If the help key is not turned on, the flow returns to the main routine without any process, while the help key is turned on, the flow proceeds to the contents of step S422 and subsequent steps in FIG. 10.

If a warning is not on display at step S416, whether the generation flag of the warning 1 is set or not is determined at step S418. If the flag is set, the flow proceeds to step S437, displaying an image indicating the specific contents of the warning 1 on LCD 107 of the operation panel, and setting a warning 1 indicating flag showing that the contents of the warning 1 is on display. Thereafter, the flow returns to the main routine.

If the generation flag of the warning 1 is not set, the control proceeds to step S419 and subsequent steps, where the same process as that for the warning 1 is performed for the contents of the warnings 2 to 4. Specifically, if the generation flag for any of the warnings is set, its specific contents is displayed on LCD 107 of the operation panel, and an indicating flag corresponding to the warning is set. Thereafter, the flow returns to the main routine. If none of the generation flags of the warnings 1 to 4 is set, the flow proceeds from step S421 to step S422.

At step S422, whether the specific contents of the warning 1 is displayed on the operation panel or not is determined. This determination is based on the presence or absence of the warning 1 indicating flag being set. If the contents of the warning 1 is on display, the contents of the warning 1 is eliminated from LCD 107, and the warning 1 indicating flag is reset at step S423. Then, a determination is made at step S424 as to whether the generation flag of the warning 2 is set or not. At this time, if the generation flag of the warning 2 is set, the flow proceeds to step S438, displaying an image indicating the specific contents of the warning 2, and setting a warning 2 indicating flag. Thereafter, the flow returns to the main routine. If the generation flag of the warning 2 is not set at step S424, the same process as described above is performed from step S425 to step S426. Specifically, whether the generation flag for each of the warnings 3 and 4 is set or not is determined. If the generation flag of the warning 3 is set, the flow proceeds to step S439, and if the generation flag of the warning 3 is not set and the generation flag of the warning 4 is set, the flow proceeds to step S440. After termination of the process in the respective steps, the flow returns to the main routine.

If the specific contents of the warning 1 is not on display at step S422, whether the specific contents of the warning 2 is on display or not is determined at step S427. If the specific contents of the warning 2 is on display, the flow proceeds to step S428 and subsequent steps, where the same process as described above is repeated. If the specific contents of the warning 2 is not on display at step S427, whether the specific contents of the warning 3 is on display or not is determined at step S432. If the specific contents of the warning 3 is on display, similar process to the above is performed in step S433 and subsequent steps, and the flow returns to the main routine. If the specific contents of the warning 3 is not on display at step S432, the control returns without any process.

As described above, the flow proceeds from step S417 to step S422 each time the help key is turned on. Turning on the help key means a request for switching indication contents of the warnings on LCD 107.

Figure 11:
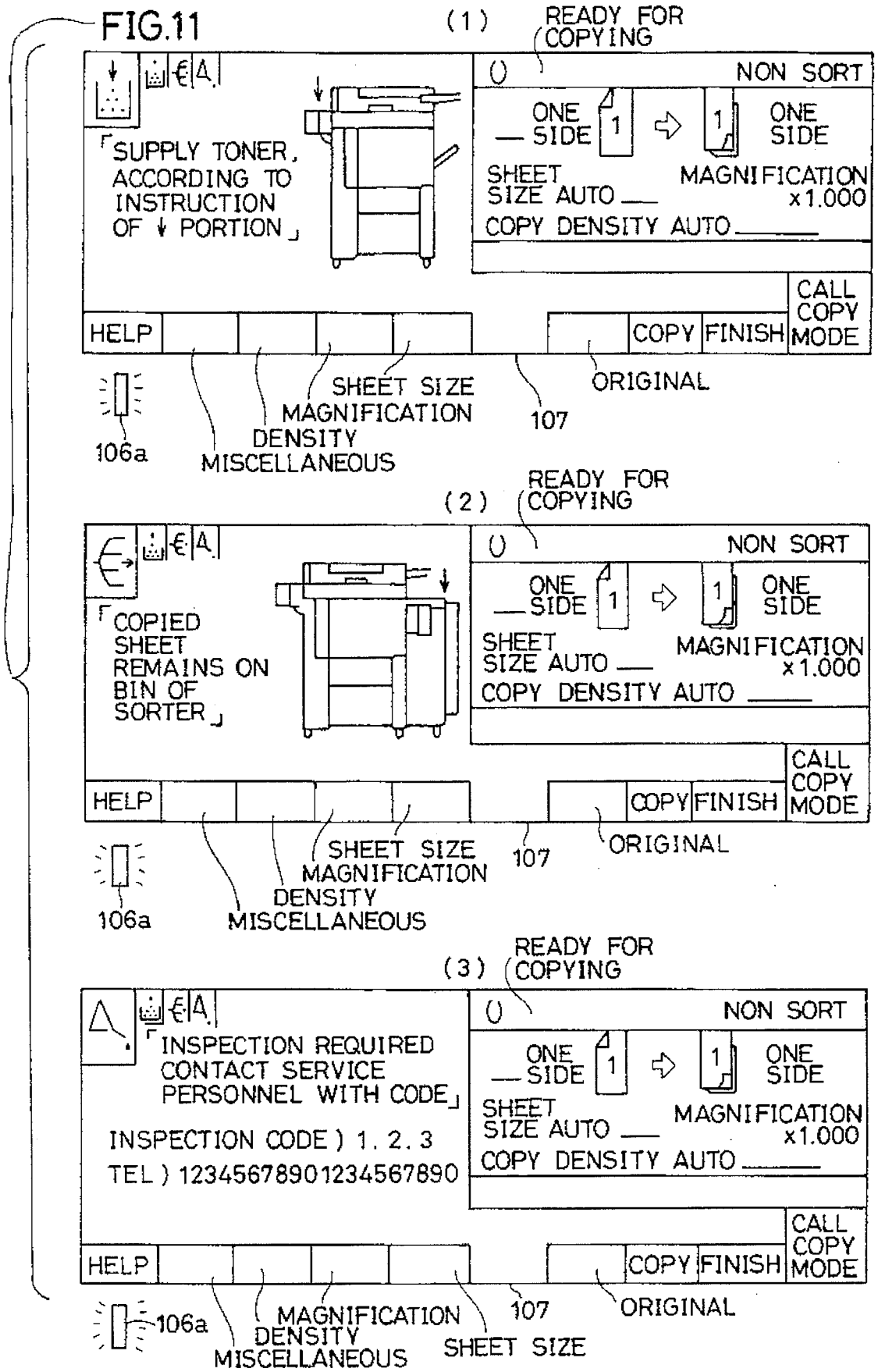
FIG. 11 shows views illustrating change in the indication of the liquid crystal display according to the first embodiment of the present invention.

FIG. 11 shows indication contents on LCD 107 of the operation panel for understanding of process contents of the flow charts in FIGS. 6 to 10.

In this example, the case of generation of three warnings, toner supply indication, copy remove indication and maintenance call indication, is shown. As shown on the upper left portion of liquid crystal display 107 in FIG. 11 (1), small pictorial characters corresponding to respective warning contents are indicated, which are arranged from the left in the order of priority of the warnings, that is, in the order of the toner supply indication, the copy remove indication and the maintenance call indication. On the left side of the pictorial characters, a pictorial character corresponding to the warning currently indicating the specific contents thereof appears in an enlarged manner. In FIG. 11 (1), the image indicating the specific contents of the toner supply indication, which is of the highest priority among these three warnings, appears on the display. In this case, the number of warnings is three, and in order to inform of the fact, help key 106*a* located to the lower left of liquid crystal display 107 is blinking.

Upon turning on help key 106*a*, the image on the liquid crystal display shown in FIG. 11 (1) changes into the image shown in FIG. 11 (2). The image shown in FIG. 11 (2) indicates the specific contents of the copy remove indication which is the warning of the second priority. Still in this state, help key 106*a* continues blinking.

Upon turning on help key 106*a*, the image shown in FIG. 11 (2) on the liquid crystal panel display changes into that shown in FIG. 11 (3). The image shown in FIG. 11 (3) indicates the specific contents with respect to the maintenance call indication which is of the lowest priority. Upon turning on help key 106*a*, the image shown in FIG. 11 (3) further changes into that shown in FIG. 11 (1), taking a round of the order.

In this embodiment, occurrence of a warning is informed by a pictorial character appearing on the liquid crystal display and blinking of help key 106*a*, while other means, such as a buzzer, may be employed for informing of occurrence of a plurality of warnings.

Figure 12:
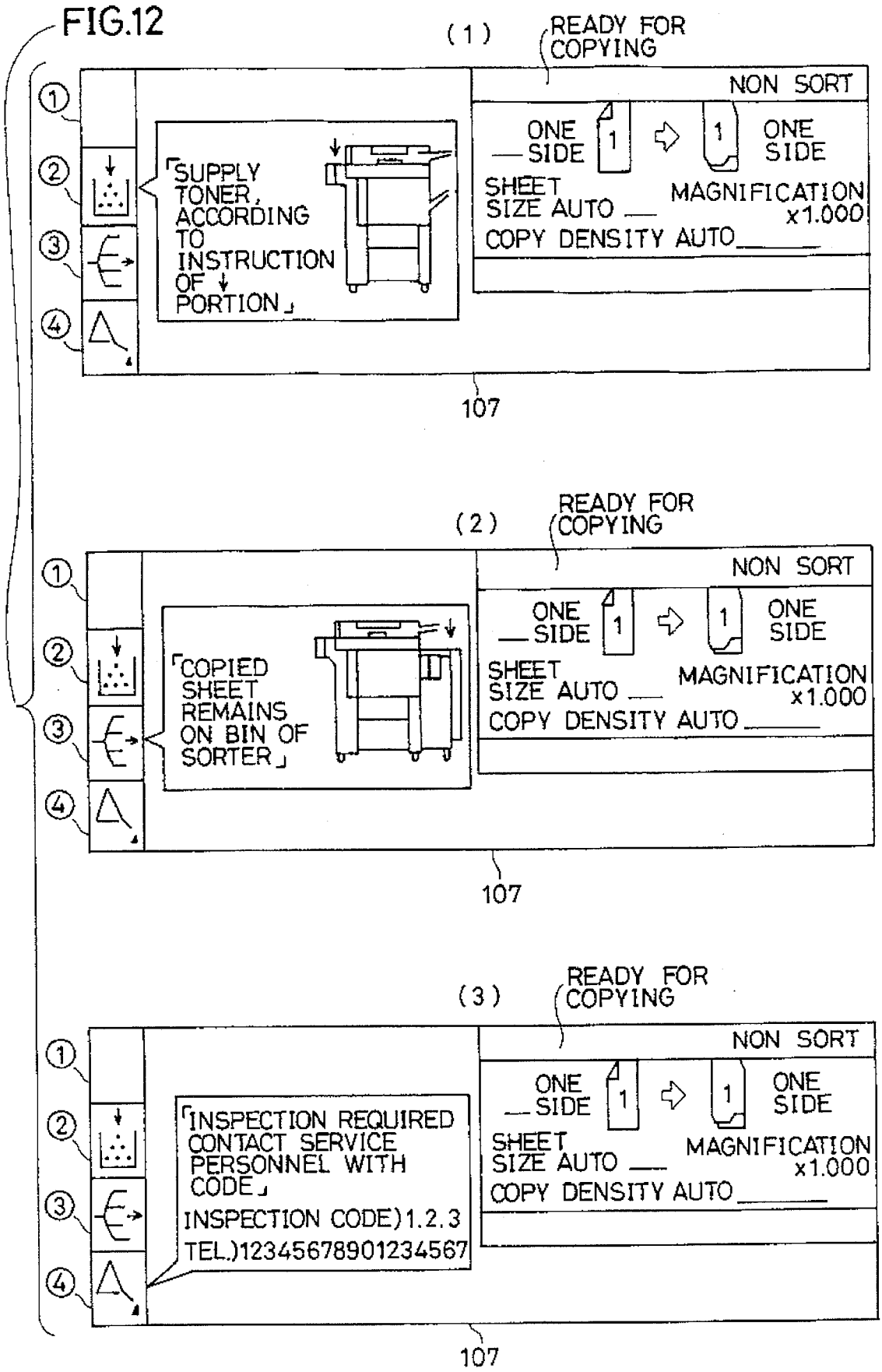
FIG. 12 shows views illustrating change in the indication of the liquid crystal display according to a second embodiment of the present invention.
Figure 13:
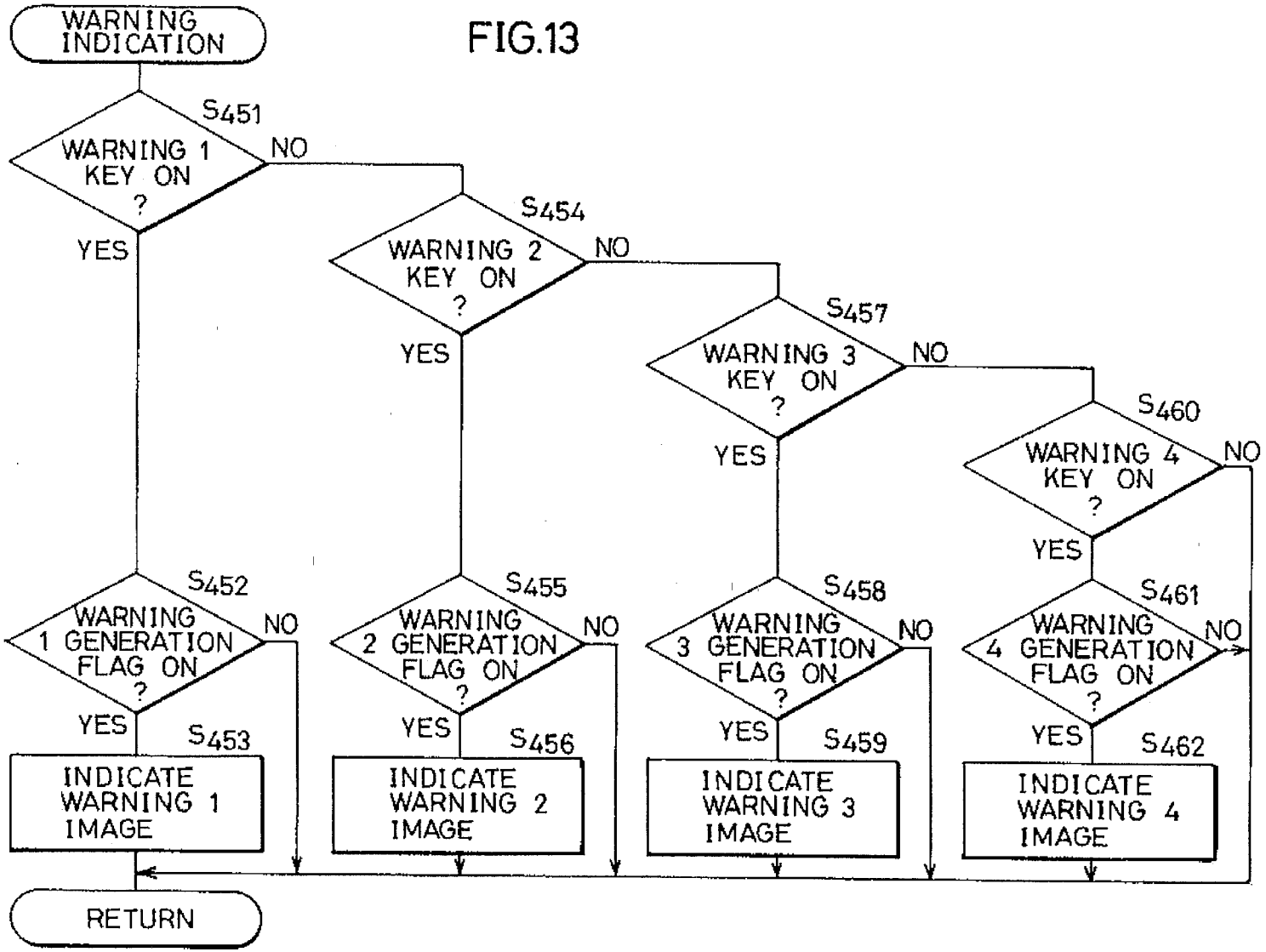
FIG. 13 is a flow chart specifically showing a warning indication routine in accordance with the second embodiment of the present invention.

FIG. 12 shows change of indication contents on the liquid crystal display of the operation panel in accordance with the second embodiment of the present invention, and FIG. 13 is a flow chart corresponding to the indication contents of FIG. 12.

Also in this embodiment, the toner supply indication, the copy remove indication and the maintenance call indication are to be indicated.

In the same manner as that of the preceding embodiment, occurrence of each warning is checked, and if occurrence of a warning is detected, a pictorial character corresponding to the warning appears on the liquid crystal display. As shown in FIG. 12 (1), the pictorial characters are indicated on the portions ①–④ in the left column of liquid crystal display 107, serving as keys, each constituted of a panel switch. Although the paper jam indication which is of the highest priority is to appear on the portion ① (warning 1 key), the pictorial character does not appear in this position because jamming of paper does not occur in this embodiment. The pictorial character corresponding to the toner supply indication appears on the portion ② (warning 2 key), the pictorial character corresponding to the copy remove indication appears on the portion ③ (warning 3 key), and the pictorial character corresponding to the maintenance call indication appears on the portion ④ (warning 4 key). In this example, when the portion ② serving as a touch key is turned on, the specific processing contents for the toner supply indication appears on the liquid crystal display, as shown in FIG. 12 (1). When the portion ③ is turned on, the image changes into the contents shown in FIG. 12 (2), indicating the specific processing contents for the copy remove indication. When the portion ④ is turned on, the specific processing contents for the maintenance call indication appears, as shown in FIG. 12 (3). When the pictorial characters appear on respective portion ①–④ described above, the specific processing contents for the corresponding warning can appear on the liquid crystal display by turning on the corresponding pictorial character as a warning key.

A user can thus be informed of occurrence of a plurality of troubles, not by blinking of the help key as in the preceding embodiment, but by indicating a plurality of pictorial characters on the liquid crystal display.

FIG. 13 is a flow chart specifically showing the contents of the warning indication routine in the second embodiment.

At step S451, whether the warning 1 key, that is, the key at the portion 1 in FIG. 12, is turned on or not is determined. If the key is turned on, whether the warning 1 generation flag is set or not is determined at step S452. If the warning 1 generation flag is set, the image indicating the processing contents for the warning 1 is displayed at step S453, and the flow returns to the main routine. If the warning 1 generation flag is not set, the flow returns to the main routine without any process.

If the warning 1 key is not turned on at step S451, whether the warning 2 key, that is, the portion ② in FIG. 2, is turned on or not is determined. If the key is turned on, whether the warning 2 generation flag is set or not is determined at step S455. If the flag is set, the image indicating the processing contents for the warning 2 is displayed at step S456, and the flow returns to the main routine. Similar process is performed with respect to warning 3 key and the warning 4 key at steps S457 and S460.

In the case where no pictorial character appears on the portion ① as shown in FIG. 12 (1), no image appears, or the image does not change, even if the warning 1 key is turned on, because the warning 1 generation flag is not set, so that the flow returns to the main routine without any process. In the second embodiment, change of the image indication is performed using touch panel-type warning keys in place of a help key, whereby the warning contents can be called out in arbitrary sequence.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

detection means for detecting a plurality of troubles;

indication means for indicating one of said detected plurality of troubles; and information means for informing of an existence of other troubles which are not being indicated by said indication means.

2. The image forming apparatus according to claim 1, further comprising instruction means for instructing indication of one of other troubles which are not being indicated, and control means for controlling said indication means to indicate said one of other troubles not indicated in response to an instruction output of said instruction means.

3. The image forming apparatus according to claim 2, wherein said instruction means includes a key switch provided independently of said indication means, and said information means includes a blinking operation of said key switch.

4. The image forming apparatus according to claim 1, wherein:

said information means informs of an existence of said other troubles by a blinking operation.

5. The image forming apparatus according to claim 4, wherein:

said information means informs of an existence of said other troubles by a blinking operation of a lamp provided on a help key.

6. The image forming apparatus according to claim 1, wherein:

said information means informs of an existence of said other troubles by sound.

7. An image forming apparatus, comprising:

detection means for detecting a plurality of troubles;

information means for informing of occurrence of the plurality of troubles based on the detected result of said detection means;

indication means for indicating a prescribed trouble among said detected plurality of troubles; and switch means for switching trouble indication of said indication means to another trouble indication which is not being on display.

8. The image forming apparatus according to claim 7, wherein trouble indication by said indication means is performed based on a predetermined order of priority.

9. The image forming apparatus according to claim 7, wherein:

said information means includes a pictorial character showing a trouble type.

10. The image forming apparatus according to claim 7, wherein:

said switch includes a touch key provided in a display screen.

11. The image forming apparatus according to claim 7 further including means for prioritizing the plurality of detected troubles, whereby activation of the switch means progressively indicates individual troubles in order of priority.

12. An image forming apparatus, comprising:

detecting means for detecting a plurality of troubles;

means for prioritizing the plurality of detected troubles;

a first indicator which indicates said detected plurality of troubles in a first mode;

a second indicator which indicates one of the plurality of troubles indicated by said first indicator in a second mode; and a switch which switches a trouble indicated by said second indicators whereby activation of the switch progressively indicates individual troubles in order of priority.

13. The image forming apparatus according to claim 12, wherein said second mode indicates trouble contents in more detail than said first mode.

14. The image forming apparatus according to claim 13, wherein:

said switch includes a touch key provided in a display screen corresponding to an indication of a pictorial character.

15. The image forming apparatus according to claim 12, wherein said first mode is a pictorial character showing a trouble type.

16. The image forming apparatus according to claim 12, wherein said switch means includes instruction means for instructing switching of a trouble to be indicated by said second indication means, and control means for controlling said second indication means to indicate said switched trouble in response to an instruction output of said instruction means.

17. The image forming apparatus according to claim 16, wherein said instruction means includes a panel switch serving as a switch when pressed on a portion indicated as said first mode by said first indication means.

18. The image forming apparatus according to claim 12, wherein:

said switch includes a touch key provided in a display screen.

19. An image forming apparatus, comprising:

detecting means for detecting a plurality of troubles;

a first indicator which indicates said detected plurality of troubles in a first mode;

a second indicator which indicates one of the plurality of troubles indicated by said first indicator, in more detail than set forth in said first mode, in a second mode; and a switch which switches a trouble indicated by said second indicator.

20. The image forming apparatus according to claim 19, further including means for prioritizing the plurality of detected troubles, whereby activation of the switch progressively indicates individual troubles in order of priority.

21. An image forming apparatus, comprising:

detecting means for detecting a plurality of troubles;

a first indicator which indicates said detected plurality of troubles as pictorial characters, each indicative of a type of trouble, in a first mode;

a second indicator which indicates one of the plurality of troubles indicated by said first indicator in a second mode; and a switch which switches a trouble indicated by said second indicator.

22. The image forming apparatus according to claim 21, further including means for prioritizing the plurality of detected troubles, whereby activation of the switch progressively indicates individual troubles in order of priority.

23. An image forming apparatus, comprising:

detection means for detecting a plurality of troubles;

first indication means for indicating said detected plurality of troubles in a first mode;

second indication means for indicating one of the plurality of troubles indicated by said first indication means in a second mode, said second mode indicating trouble contents in more detail than said first mode; and switch means for switching a trouble to be indicated by said second indication means.

24. An image forming apparatus, comprising:

detection means for detecting a plurality of troubles;

first indication means for indicating said detected plurality of troubles in a first mode, said first mode being a pictorial character showing a trouble type;

second indication means for indicating one of the plurality of troubles indicated by said first indication means in a second mode; and switch means for switching a trouble to be indicated by said second indication means.

* * * * *